United States Patent [19]

Anderson

[11] Patent Number: 4,607,548

[45] Date of Patent: Aug. 26, 1986

[54] PLIERS

[75] Inventor: J. Edward C. Anderson, Moreland Hills, Ohio

[73] Assignee: Milbar Corporation, Chagrin Falls, Ohio

[21] Appl. No.: 729,990

[22] Filed: May 2, 1985

[51] Int. Cl.[4] ..... B25B 7/02

[52] U.S. Cl. ..... 81/427; 30/261

[58] Field of Search ..... 81/427; 30/261, 262

[56] References Cited

U.S. PATENT DOCUMENTS

| | | | |
|---|---|---|---|
| 770,032 | 9/1904 | Wilcox | 30/262 |
| 1,957,589 | 5/1934 | Harvey . | |
| 2,938,266 | 5/1960 | Klein | 30/261 |
| 3,398,451 | 8/1968 | Angguist . | |
| 3,416,226 | 12/1968 | Pfaffenbach | 30/261 |

FOREIGN PATENT DOCUMENTS

| | | | |
|---|---|---|---|
| 2128359 | 6/1973 | Fed. Rep. of Germany . | |
| 785709 | 11/1957 | United Kingdom | 30/261 |

*Primary Examiner*—James L. Jones, Jr.

*Attorney, Agent, or Firm*—Watts, Hoffmann, Fisher & Heinke Co.

[57] ABSTRACT

Apparatus and method for biasing the handles of a plier-type tool. The tool includes a pair of pivotally connected members, each member having a handle portion and a jaw portion joined together by an interconnecting portion. The interconnecting portions define pivot structure by which the members are rotatably connected and structure for capturing a coil spring that is operative to urge the handles apart. When embodied in an internal retaining plier, the handles are urged towards an equilibrium position. The spring capturing structure in each region comprises a slot defined by a pair of nonconverging arcuate edges joined at one end by a rectilinear edge forming a spring abutment and a spring seat at the other end including a spring retaining tongue. The tongue is disposed in a plane diverging from the plane of the interconnecting region and extends inwardly such that when the handles are squeezed, the tongues of respective interconnecting region abut to provide a mechanical stop defining the maximum squeezed position of the handles.

13 Claims, 7 Drawing Figures

PLIERS

DESCRIPTION

1. Technical Field

The present invention relates generally to hand tools and, in particular, to an apparatus and method for spring biasing handles in a pair of pliers.

2. Background Art

In many types of pliers such as retaining ring pliers, a biasing arrangement is provided to either urge the handles apart or, alternately, to urge the handles toward each other. Various methods for providing the biasing have been proposed or suggested. In some arrangements, a spring is disposed between the handles and acts directly on the handles to either urge them together or apart. In other arrangements, a torsional spring is mounted at a pivot and includes arms that engage and apply a biasing force to the handles.

Separate fasteners such as rivets are often used to secure the spring to the tool. If rivets are employed, rivet holes must be machined or formed at approximate locations, adding manufacturing cost to the tool.

In many if not most of these constructions, the spring mechanism can add significant bulk to the tool and in some cases make the tool difficult to use. The spring mechanisms normally urge the handles to an extreme open or closed position. The maximum closed or open position of the handles is normally determined by an obstruction or interference in the relative movement of the handles. When the handles are urged apart by a spring, the handles may be spread apart to a distance that makes the tool difficult to grasp initially and therefore awkward to use.

DISCLOSURE OF INVENTION

The present invention provides a new and improved plier construction in which an integral biasing arrangement is incorporated that normally urges the operating handles away from each other. The biasing mechanism is integrated and captured within the tool and does not add significant bulk to the overall construction. The biasing arrangement is inexpensive and reliable and does not compromise the use or the handling of the tool.

The present invention is disclosed in connection with a plier used for removing and installing retaining rings. It should be noted, however, that the invention is adaptable to a wide variety of plier constructions and should not be limited to the disclosed application.

According to the invention, the plier includes a pair of pivotally mounted members. Each member includes a handle portion, a jaw portion and an interconnecting region that joins the jaw portion to the handle portion. In the disclosed embodiment, the jaw portion of each plier member defines structure by which tips, used to engage retaining rings, can be mounted.

According to the invention, the interconnecting regions of the plier members define structure for capturing a biasing element, preferably a coil spring. The spring urges the operating handles towards an equilibrium position preferably located intermediate a fully spread position and a fully closed position. In particular, the equilibrium position is selected to maintain the handles in a position at which they can be easily gripped by the user with one hand.

In the preferred and illustrated embodiment, the interconnecting region of each plier member defines an aperture or slot. The apertures defined by the members are mutually alignable when the members are in a predetermined relative position.

Each aperture includes a spring seat and a spring abutment defined preferably by an edge located opposite an edge that defines the spring seat. The coil spring is mutually engaged by the slots formed in the interconnecting regions of the plier members. The slot in one region is located in an inverted relation to the slot in the other region such that when the slots are aligned, the spring abutment of one slot is substantially adjacent the spring seat of the other slot and the spring abutment of the other slot is substantially adjacent the spring seat of the one slot.

The slots include structure for capturing the spring and maintaining it in position. Preferably each slot includes a tongue that extends from the spring seat towards the associated spring abutment but terminates intermediate the abutment and seat. Since the slots are in an inverted relation, the tongues of respective slots extend towards each other. Consequently, the tongue of one slot is received at one end of the spring, whereas the tongue of the other slot is received at the other end. With this configuration, the tongues prevent dislodgement of the coil spring from the slots.

According to a feature of the invention, the free length of the coil is selected to be larger than the distance between the spring seat and spring abutment of a given slot. As a result, the coil spring is always slightly compressed further aiding in the securement of the spring in the slots.

In accordance with a preferred and illustrated embodiment, the spring and slot arrangement cooperate to urge the operating handles of the pliers towards an equilibrium position that is preferably intermediate the fully spread and fully squeezed positions. Since the spring continually urges the operating handles toward a position at which the slots will be mutually aligned, the equilibrium position is determined by the size and location of the slots in the interconnecting regions of the plier members.

In accordance with a feature of the invention, each spring locating tongue is disposed in a plane that diverges from the plane defined by its associated interconnecting region. In the preferred embodiment the tongues diverge inwardly with respect to the outer surface of the tool. With this construction, when the handles are squeezed, the tongues ultimately meet to provide a mechanical stop and define a maximum "squeezed" position for the pliers. Thus the tongues serve two functions. They capture the spring in the slots and provide a mechanical stop for handle movement.

In the exemplary embodiment, each spring slot is defined by a pair of spaced apart arcuate edges each located at a spaced radial distance from the pivot of the plier. The spring abutment is defined by a substantially rectilinear edge that connects the arcuate edges on one end. The spring seat is defined by the tongue (that extends towards the interior of the slot) and a pair of radiused edge segments disposed on either side of the tongue which connect the tongue with the arcuate edges.

It should be apparent that the invention provides an extremely useful and inexpensive means for integrating a spring biasing arrangement in a plier-type tool. By the appropriate sizing of the spring apertures or slots, an equilibrium position for the operating handles can be provided which facilitates the handling and gripping of the tool.

The disclosed tool construction can be easily fabricated using well known manufacturing methods such as stamping or powdered metal technology. When embodied on a retaining ring plier, an inexpensive but extremely useful tool can be inexpensively produced.

Additional features of the invention will become apparent and a fuller understanding obtained by reading the following detailed description made in connection with the accompanying drawings.

BEST MODE FOR CARRYING OUT INVENTION

Figure 1:
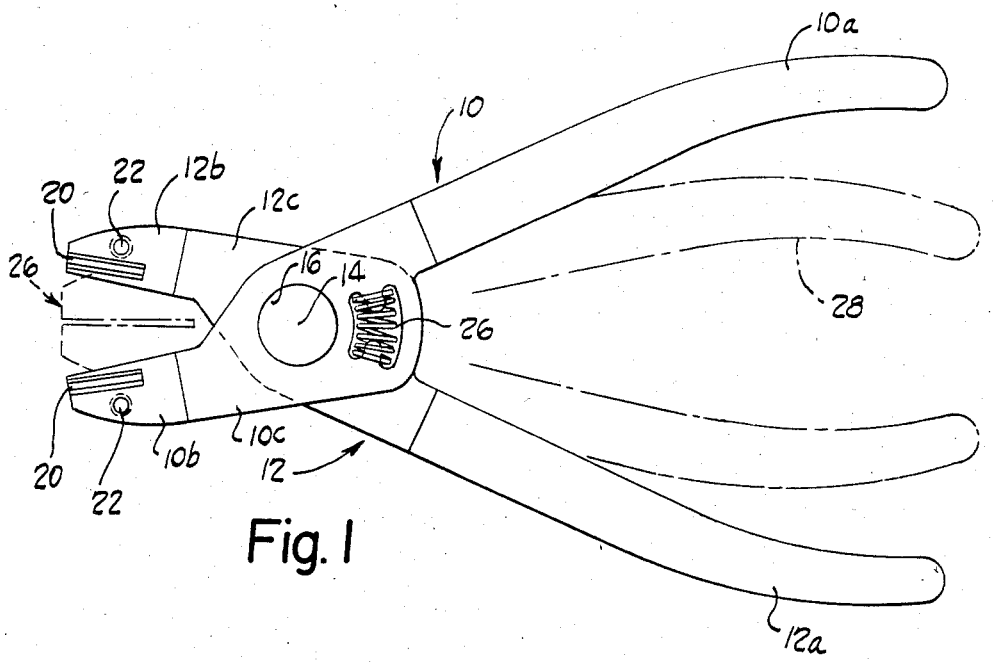
FIG. 1 is an overall elevational view of a pair of retaining ring pliers embodying the present invention.
Figure 2:
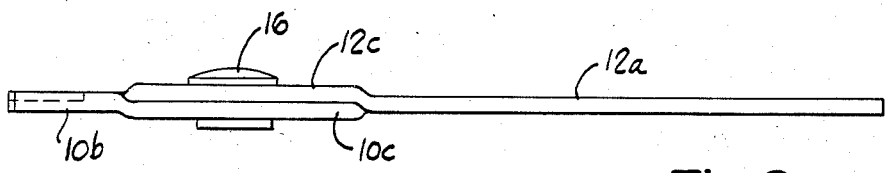
FIG. 2 is a side, elevational view of the pliers shown in FIG. 1.
Figure 3:
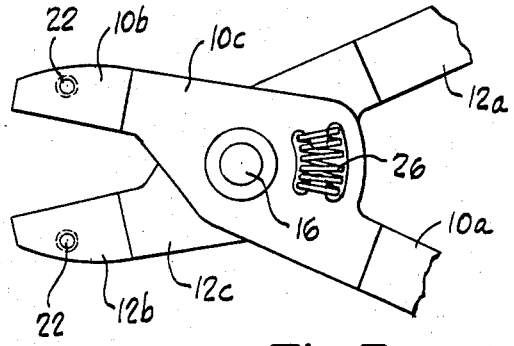
FIG. 3 is a fragmentary, side elevational view illustrating another side of the pliers shown in FIG. 1.

FIG. 1 illustrates the overall construction of a plier-type hand tool constructed in accordance with a preferred embodiment of the invention. The tool includes a pair of pivotally connected members 10, 12 suitably joined for rotational movement about a pivot axis 14. Each member includes an associated handle portion 10*a*, 12*a*, a jaw portion 10*b*, 12*b* and an interconnecting or web portion 10*c*, 12*c* joining the handle and jaw portions. As seen best in FIG. 2, the web portions 10*c*, 12*c* are disposed in offset planes so that the associated jaw and handle portions are in a common plane. When assembled, the web portions 10*c*, 12*c* are disposed in axial adjacency whereas the jaw handle portions 10*a*, 12*a* and jaw portions 10*b*, 12*b* are in a substantially common plane. A rivet 16 or other suitable fastener rotatably joins the interconnecting sections 10*c*, 12*c* and defines the pivot axis 14.

In the illustrated embodiment, the jaws 10*b*, 12*b* each include a groove 20 and threaded aperture 22 by which a tip (not shown) is mounted to the jaw. As is known, the tips protrude from the ends of the jaws and are adapted to engage apertures formed in a retaining ring (not shown) such that upon squeezing the handles 10*a*, 12*a*, the jaws move towards each other thereby contracting the retaining ring to facilitate installation or removal.

In accordance with the invention, a biasing arrangement, preferably a coil spring 26 is captured in the interconnecting sections 10*c*, 12*c*. The spring 26 urges the handles towards an equilibrium position (shown in solid line). The squeezed position of the handles is shown in phantom and designated by the reference character 28.

Figure 4:
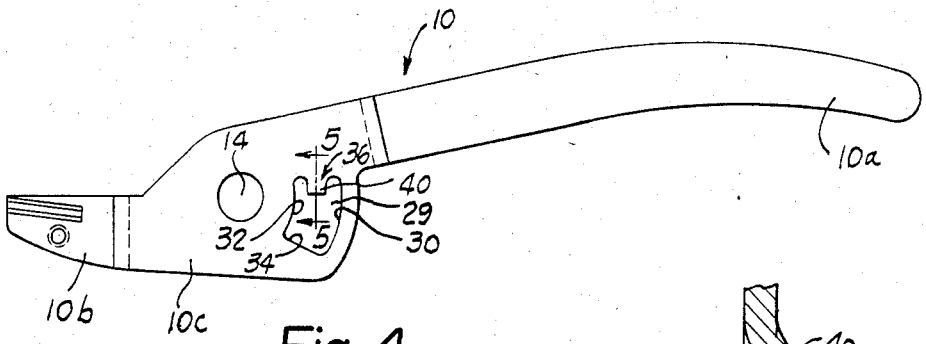
FIG. 4 is a side elevational view of one of the plier members.
Figure 5:
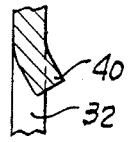
FIG. 5 is a sectional view as seen from the plane indicated by the lines 5—5 in FIG. 4.
Figure 6:
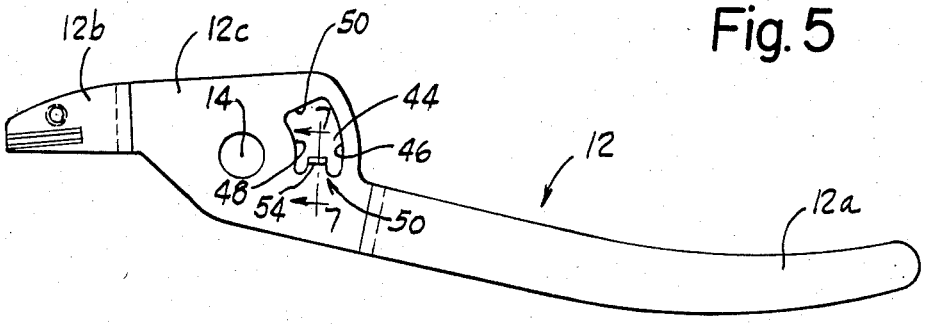
FIG. 6 is an elevational view of another plier member.
Figure 7:
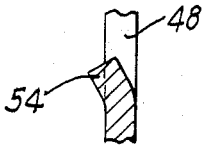
FIG. 7 is a sectional view as seen from the plane indicated by the lines 7—7 in FIG. 6.

Referring also to FIGS. 4 and 6, the plier member 10 includes a slot or opening 29 defined by a pair of arcuate edges 30, 32 spaced apart by an end wall 34 on one end and a spring seat structure 36 at the other end. The seat structure 36 includes a lug or tongue 40 that extends into the slot 29 and is disposed in a diverging plane, (as seen in FIG. 5) with respect to the plane of the interconnecting section 10*c*. Each arcuate edge 30, 32 is preferably located a uniform radial distance from the pivot axis 14 the actual radial distance for the edge 30 being greater than that of the edge 32.

The member 12 includes a similar construction including a complementally shaped slot 44 defined by arcuate edges 46, 48, an end wall 50 and a spring seat structure 52. The seat includes a diverging tongue 54.

When the members 10, 12 are pivotally connected, the slots are alignable such that one overlies the other when the members are in a predetermined rotative position.

After installation, the coil spring 26 mutually engages both slots. The spring is selected so that its free length is greater than the width of the slot so that once installed, the spring is always under some compression.

When the spring 26 is mounted in the slots 29, 44, one end of the spring 26 seats around the lug 40 in one member whereas the opposite end of the spring 26 seats around the lug 54 of the other member. In addition the end walls 34, 50 of the slots 29, 44 are also engageable with the ends of the spring.

When the operating handles 10, 12 are squeezed, the spring seats 36, 52 formed on the respective members 10, 12 move towards each other thus compressing the spring and increasing the biasing force tending to spread the handles apart. When the tool is released, the operating handles are driven to the spread position shown in FIG. 1.

When the handles reach the outward or "equilibrium" position shown in FIG. 1, the end walls 34, 50 of the slots 29, 44, respectively each engage the ends of the spring. The hand tool is then maintained in an "equilibrium position". With this construction, spreading the handles beyond the equilibrium position causes the spring to be compressed by the converging end walls 34, 50 of the slots 29, 44, thus generating a biasing force tending to drive the handles together. As a result, a single coil spring 26 provides a biasing force on the handles that can act in two directions. When the handles are squeezed, the spring urges the handles apart whereas when the handles are pulled apart beyond the equilibrium position, the spring urges them towards each other.

As seen best in FIGS. 4–7 in the preferred embodiment, the tongues 40, 54 diverge towards a center plane of the tool. In other words, when assembled, both lugs appear to diverge inwardly with respect to the external surface of the tool. When the handles are squeezed, the tongues eventually meet and thus provide a mechanical stop delimiting a maximum "squeezed" position of the handles. This feature prevents the coil spring 26 from being fully compressed and should prolong the life of the spring.

As best seen in FIGS. 4 and 6, the outermost end of each tongue 40, 54 lies along a radial line extending from the pivot axis 24. The total amount of compression for the spring 26 from its "equilibrium position" is thus determined by the distance between the outermost edges of the tongues 40, 54 when the slots 29, 44 are aligned.

The arcuate edges of each slot (i.e., edges 30, 32 of the slot 29) are spaced a uniform radial distance from each other (with respect to the pivot axis 14). The use of arcuate edges enhances the securement of the spring within the slots because it tends to reduce the incidence of buckling in the spring as the handles are squeezed. The radial distance by which the edges are spaced is selected to be substantially the diameter of the spring plus a modest clearance.

Unlike many prior tools, the handles of the illustrated pliers are maintained in a position that facilitates grasping the tool. The outward position of the operating handles is determined by the dimensions of the spring slots and not by mechanical stops in the tool or interference between the members that occurs when the handles are spread to extreme positions.

In addition, it should be apparent that the tool members 10, 12 as seen in FIGS. 4 and 6 are substantially identical, except for the location of the tip grooves 20 in the jaws 10*b*, 12*b*. For some applications, a single die can be used to stamp out each of the plier members 10, 12. The manufacture of this type of plier would then consist of stamping two identical plier members and then joining the members with a suitable fastener such as a rivet. The tip may also be integrally formed with the jaws.

It should be apparent that the present invention provides a simple but effective method for both biasing the members of a plier type tool while preventing the handles from being spread to a position that would make the tool difficult to initially grasp.

The present invention has been described in connection with a retaining ring tool and, in particular, one intended for use with internal type retaining rings. This invention however can be adapted to both internal and external type retaining ring pliers as well as pliers in general when the need for biasing the handles is needed or desirable.

Although this invention has been described with a certain degree of particularity, it should be understood that those skilled in the art can make various changes to it without departing from the spirit or scope of the invention as hereinafter claimed.

I claim:

1. Pliers comprising:

(a) a pair of pivotally connected members;

(b) each member defining a handle portion, a jaw portion and a web portion joining said jaw portion to said handle portion;

(c) structure defining a pivot in the web portions of each member;

(d) said web portions defining associated slots, mutually alignable when the members are in a predetermined relative position;

(e) each slot defining a spring seat including a tongue extending towards an intermediate region of said slot;

(f) said slot further including a spring abutment defined by an edge spaced from said tongue, said spring abutment located in spaced confronting relation with said spring seat;

(g) said slots being in an inverted relationship with respect to each other when said members are pivotally connected such that said spring seats move towards or away from each other, in spaced, but substantially parallel, rotational planes when said handle portions are moved relative to each other;

(h) a compression spring captured in said slots, one end of said spring engaging the tongue of one member, another end of said spring concurrently engaging the tongue of the other member and the spring abutment of the one member, when the members are in a predetermined position.

2. The apparatus of claim 1 wherein said tongues are disposed in diverging planes with respect to a plane defined by said web portion.

3. A plier apparatus comprising:

(a) a pair of pivotally connected members;

(b) each member including a handle portion, a jaw portion and a web portion interconnecting said jaw and handle portions;

(c) pivot means pivotally connecting said web portions such that said web portions rotate in parallel but spaced rotational planes, said web portions being disposed in substantially axial adjacency;

(d) each web portion defining an aperture for receiving at least a portion of a biasing spring, said apertures being similarly configured in each of said web portions and being positioned such that said apertures are mutually aligned when said handle portions are in a predetermined position;

(e) each aperture defined by spaced, non-converging arcuate edges and spaced end walls disposed at opposite ends of said arcuate edges, one of said end walls of each aperture defining a tongue extending towards an opposite end wall, said opposite end wall defining a spring abutment;

(f) a coil spring captured in said apertures and maintained in position by said tongues, one end of said spring concurrently engageable with the tongue of one member and the spring abutment of the other member.

4. The apparatus of claim 3 wherein said handle portion and jaw portion of each member are disposed in a substantially common plane and said web portion is disposed in an offset plane, parallel and spaced from said common plane.

5. The apparatus of claim 3 wherein each jaw portion defines structure for mounting tips for engaging retaining rings.

6. The apparatus of claim 3 wherein said pivotally connected members are substantially identical to each other.

7. The apparatus of claim 2 wherein said tongues diverge towards a common center plane of said tool such that when said handles are squeezed said tongues eventually abut to provide a mechanical stop to delimit a maximum squeezed position of said tool.

8. Pliers comprising:

(a) a pair of pivotally connected members;

(b) each member defined by a handle portion, a jaw portion and an interconnecting region joining said jaw portion to said hand portion;

(c) pivot means extending through said interconnecting regions, allowing relative rotative movement between said members about an axid defined by said pivot means;

(d) each interconnecting region defining an associated slot, said slots being mutually alignable when the members are in a predetermined relative position;

(e) each slot defining a spring seat including a tongue extending towards an intermediate portion of said slot, and disposed in a diverging plane with respect to a plane defined by the associated interconnecting region;

(f) the tongues of said slots extending towards each other such that upon predetermined pivotal movement of said handle portions, peripheral edges of said tongues abut to provide a mechanical stop to delimit the maximum squeezed position of said handle portions;

(g) said tongues further operative to maintain the position of a coil spring captured by said slots such that said handles are squeezed, said coil spring is compressed by the movement of said spring seats towards each other, said coil spring being selected such that when said tongues reach the maximum squeezed position, said coil spring is not fully compressed.

9. The pliers of claim 8 wherein each slot further defines a spring abutment defined by an edge spaced from the tongue of each slot, said spring abutments cooperating to urge said handle portions towards an equilibrium position when said handles are released.

10. The pliers of claim 8 wherein said handle portions and jaw portions are disposed in a substantially common plane and said interconnecting regions are disposed in a side-by-side relationship in spaced, but parallel, planes.

11. A plier type tool, comprising:

(a) a pair of pivotally connected members;

(b) each member defining a handle, a jaw and a web joining said jaw to said handle, said jaw and handle of each member being disposed in substantially a common plane and said web being disposed in an offset plane such that when said members are in their operative positions, the handles and jaws of both members are in a substantially common plane and said webs are disposed in spaced, but parallel, planes;

(c) structure defining a pivot extending through said webs, said pivot defining an axis about which said members are relatively rotatable;

(d) each web portion defining an associated slot, said slots being mutually alignable such that the slot of one member substantially overlies the slot of the other member, when the members are in a predetermined relative position;

(e) each slot defining a spring seat including a tongue extending towards but spaced from a spring abutment defined by an edge of said slot, said spring abutment located in confronting relation with respect to said spring seat;

(f) said slots being in an inverted relationship with respect to each other when said members are pivotally connected such that said spring seats move towards and away from each other, in spaced, but parallel, rotational planes when said handles are moved relative to each other;

(g) a coil spring captured in said slots by said tongues and selected to have a free length greater than a longitudinal dimension of said slots and having a diameter substantially conforming to a transverse dimension of said slots.

12. A plier apparatus comprising:

(a) a pair of pivotally connected members;

(b) each member including a handle portion, a jaw portion and a web portion interconnecting said jaw and handle portions, said handle portion and jaw portion of each member being disposed in a substantially common plane and said web portion of each member being disposed in an offset plane, parallel and spaced from said common plane;

(c) pivot means pivotally connecting said web portions such that said web portions rotate in parallel but spaced rotational planes, said web portions being disposed in substantially axial adjacency;

(d) each web portion defining an aperture for receiving at least a portion of a biasing spring, said apertures being similarly configured in each of said web portions and being positioned such that said apertures are mutually aligned when said handle portions are in a predetermined position;

(e) each aperture defined by spaced, non-converging arcuate edges and spaced end walls disposed at opposite ends of said arcuate edges, one of said end walls of each aperture defining a tongue extending towards an opposite end wall, said opposite end wall defining a spring abutment;

(f) a coil spring captured in said apertures and maintained in position by said tongues.

13. Pliers comprising:

(a) a pair of pivotally connected members;

(b) each member defined by a handle portion, a jaw portion and an interconnecting region joining said jaw portions to said handle portion, said handle portions and jaw portions of said members being disposed in a substantially common plane and said interconnecting regions of said members being disposed in a side-by-side relationship in spaced, but parallel planes;

(c) pivot means extending through said interconnecting regions, allowing relative rotative movement between said members about an axis defined by said pivot means;

(d) each interconnecting region defining an associated slot, said slots being mutually alignable when the members are in a predetermined relative position;

(e) each slot defining a spring seat including a tongue extending towards an intermediate portion of said slot, and disposed in a diverging plane with respect to a plane defined by the associated interconnecting region;

(f) the tongues of said slots extending towards each other such that upon predetermined pivotal movement of said handle portions, peripheral edges of said tongues abut to provide a mechanical stop to delimit the maximum squeezed position of said handle portions;

(g) said tongues further operative to maintain the position of a coil spring captured by said slots such that as said handles are squeezed, said coil spring is compressed by the movement of said spring seats towards each other, said coil spring being selected such that when said tongues reach the maximum squeezed position, said coil spring is not fully compressed.

* * * * *